US005957143A

United States Patent [19]

Schmidt

[11] Patent Number: 5,957,143

[45] Date of Patent: Sep. 28, 1999

[54] PROCESS FOR THE MECHANICAL CLEANING OF REUSABLE DRINKS CONTAINERS

[75] Inventor: Michael G. Schmidt, Wiesbaden, Germany

[73] Assignee: Diversey Lever, Inc., Plymouth, Mich.

[21] Appl. No.: 08/953,443

[22] Filed: Oct. 17, 1997

[30] Foreign Application Priority Data

Oct. 28, 1996 [DE] Germany ..... 196 44 742

[51] Int. Cl.[6] ..... B08B 9/20; B08B 9/093

[52] U.S. Cl. ..... 134/25.2; 134/22.1; 134/22.18; 134/22.19; 134/32; 134/34

[58] Field of Search ..... 134/25.1, 25.2, 134/25.4, 22.1, 22.18, 23, 24, 26, 28, 34, 22.19, 22.16, 2, 3

[56] References Cited

U.S. PATENT DOCUMENTS

| | | | |
|---|---|---|---|
| 2,263,627 | 11/1941 | Herold . | |
| 2,634,737 | 4/1953 | Rowe . | |
| 4,125,120 | 11/1978 | Standley | 134/126 |
| 4,667,690 | 5/1987 | Harting | 134/62 |
| 5,285,801 | 2/1994 | Klenk | 134/73 |
| 5,356,481 | 10/1994 | Yoshimura et al. | 134/22.1 |
| 5,409,545 | 4/1995 | Levey et al. | 134/22.18 |
| 5,441,063 | 8/1995 | Fernandez et al. | 134/142 |

FOREIGN PATENT DOCUMENTS

| | | |
|---|---|---|
| 282 214 | 10/1991 | European Pat. Off. . |
| 2 011 786 | 3/1970 | France . |
| 505 015 | 7/1930 | Germany . |
| 3 707 366 | 9/1988 | Germany . |
| 93/24841 | 12/1993 | WIPO . |

*Primary Examiner*—Jill Warden
*Assistant Examiner*—Alexander Markoff

[57] ABSTRACT

In the case of a process for the mechanical cleaning of reusable drinks containers made of glass or plastic, the process comprising one or more washing cycles or zones and rinsing cycles or zones in a cleaning installation, the reusable drinks containers undergo pretreatment before being supplied to the actual cleaning installation. The reusable drinks containers are sprayed with an aqueous cleaning formulation by means of one or more nozzles which produce a spray yet which is directed into the interior of the reusable containers and, in the interior of the reusable containers, is transformed into a spray mist, with the result that the cleaning formulation is distributed uniformly. The pretreatment ensures that even stubborn dirt or microorganisms such as mold or yeasts is/are removed effectively in the cleaning installation.

7 Claims, 3 Drawing Sheets

PROCESS FOR THE MECHANICAL CLEANING OF REUSABLE DRINKS CONTAINERS

FIELD OF THE INVENTION

The invention relates to a process for the mechanical cleaning of reusable drinks containers made of glass or plastic, in particular bottles made of PET, PEN or PC.

BACKGROUND OF THE INVENTION

DE 3 707 366 A1 discloses a process which is intended for the continuous mechanical cleaning of everyday crockery and in the case of which the crockery which is contaminated with bits of food is doused with water in a prewashing cycle or a prewashing zone. Following the prewashing zone or the prewashing cycle, the crockery passes into a washing zone or a washing cycle, where it is sprayed with a metered washing liquor, which comprises preheated water to which a detergent has been added. Consequently, in particular dried-on or baked-on bits of food are swollen and detached.

In a clear-washing zone, which follows the washing zone or the washing cycle, and in a rinsing zone, the detached bits of food are then removed together with the washing liquor.

In order to reduce the resulting waste-water contamination and to achieve better cleaning of the crockery, a highly concentrated detergent solution is sprayed onto the crockery in finely distributed form in the washing zone and, after a certain contact time, is washed off in the clear-washing and rinsing zone together with the detached bits of food.

In addition to the processes for cleaning everyday crockery, processes for cleaning reusable drinks containers are also known. The known reusable drinks containers, in particular glass and plastic bottles, undergo intensive cleaning before being refilled. And this cleaning operation has to satisfy the stringent requirements as laid down by food regulations. In the case of automatic filling installations, cleaning and filling of the drinks containers generally takes place in a self-contained installation. The known installations generally comprise a transporting device for the crates which contain the bottles, a device for unpacking the bottles and unscrewing the closure elements, a device for tracing, in the bottles, residues of substances which are a health hazard, this device also being known as a sniffer, a machine for cleaning the bottles, a filling device, a device for screwing on the closure caps, and a device for packing the bottles into the crates and for transporting the bottle crates.

In the case of the known standard cleaning processes, cleaning of the reusable drinks containers takes place exclusively in the cleaning machine, which usually contains up to three lye baths. The concentration of NaOH therein is between 1.0 and 3.0% by weight, between 0.05 and 1.0% by weight of additives being metered into the lyes in order to stabilize hardness and to assist cleaning. Although such standard cleaning processes have proven successful in practice, there is a risk, in particular in the case of cleaning reusable plastic bottles made of PET, PEN and PC, that dirt which cannot readily be dissolved or else microorganisms such as mould and yeast is/are only partially removed in a cleaning machine, if at all.

DEFINITION OF THE INVENTION

The object of the invention is to specify a process which ensures complete removal of firmly adhering dirt and microorganisms such as mould and yeasts.

The present invention describes a process for mechanically cleaning reusable drink containers made out of glass or plastic. The process has one or more washing cycles or zones and rinsing cycles or zones. In a pretreatment installation, an aqueous cleaning formation is sprayed onto the soiled containers by one or more spray nozzles which produce a spray jet which is directed through the opening into the interior of the containers. Once inside the drink containers, the formation is changed into a spray mist so that the cleaning formulation is uniformly distributed in the interior of the containers.

DETAILED DESCRIPTION OF THE INVENTION

In order to achieve uniform distribution of the cleaning formation in the interior of the reusable drinks containers, it is critical that, once it has entered into the container, the spray jet is transformed into a spray mist. In the case of the known reusable drinks bottles, uniform distribution of the cleaning formulation, in particular in the critical regions of the bottle neck, is advantageously achieved by a spray mist in the form of a hollow cone.

The bottles are pretreated preferably during transportation to the cleaning installation. In the case of the filling lines known in the drinks industry, the cleaning formulation is sprayed downstream of the unscrewing device and, if present, downstream of the sniffer, as seem in the conveying direction.

The contact time of the cleaning formulation is preferably between 0.5 and 30 minutes. The reusable drinks containers are deliberately not sprayed during the contact time. In the case of particularly firmly adhering dirt, the empties may also be stored intermediately before they enter into the cleaning installation and may undergo pretreatment there in order to achieve contact times of up to a number of weeks. It was preferred, however, to incorporate the pretreatment in the known filling lines, it being possible for a sufficient contact time to be ensured generally without a reduction in the transporting speed.

A preferred embodiment provides that, during the pretreatment, a conveying device conveys the reusable containers in a number of rows and a multiplicity of nozzles spray the reusable containers with the cleaning formulation, in which case, depending on the strength and nature of the dirt, the volume of liquid discharged from each nozzle is between 1 and 20 l/h.

The aqueous cleaning formulation preferably contains at least 0.5% by weight of one or more active detergents. The cleaning formulation is highly concentrated and is preferably mixed, directly before discharge, with lyes, acids or stabilizer solutions for the detergents via a metering system with water, the concentration of the cleaning formulation in the application solution being between 0.1 and 100% by weight, preferably between 0.5 and 3% by weight.

A product which is suitable for removing the adhering dirt may be formulated from the following:

| | |
|---|---|
| Inorganic acid(s) | 30 to 50% |
| Wetting agent(s) | 18 to 28% |
| Dispersing polymer(s) | 2 to 7% |
| Threshold agent | 2 to 7% |
| Chelating agent(s) | 5 to 10% |
| Water to make up the remainder. | |

An installation which is designed as a belt-type transporting machine and belongs to a filling line which is typical in the drinks industry, in the case of which the reusable drinks containers are pretreated by the process according to the invention, is explained in more detail hereinbelow with reference to the drawings:

Figure 1:
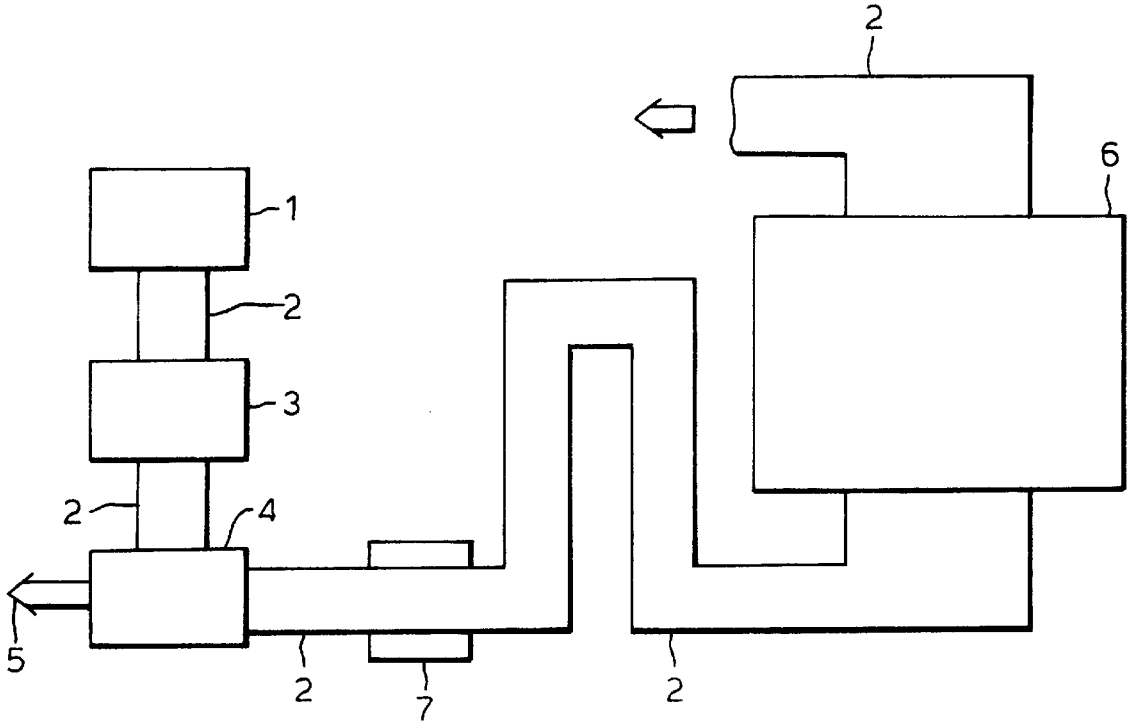
FIG. 1 shows a schematic illustration of the essential assemblies of a filling line for reusable bottles made of PET, PEN or PC with a pretreatment installation.

The filling line has a device 1 for unpacking the bottles which are located in the crates. The bottles removed from the crates are transported, on a belt conveyor 2, into a device 3 for unscrewing the closure caps. Arranged downstream of the unscrewing device 3, as seen in the conveying direction, is a device 4 for tracing residues of substances which are a health hazard, e.g. petrol or the like, and this device has a suitable sensor. If the sensor in the device 4, which is also known as a sniffer, detects a corresponding substance, the bottle is directed away for final recovery 5. The bottles passing the sniffer 4 are conveyed to a cleaning installation 6 of known construction by means of the belt conveyor 2, in which cleaning installation the bottles are cleaned in one or more washing cycles or zones and rinsing cycles or zones. The cleaning installation 6 comprises a bottle-supply means, two dipping lyes with spraying and draining zones located between them, a hot-water zone, a cold-water zone, a clean-water spray means and the bottle-discharging means. The pretreatment installation 7 for carrying out the process according to the invention is arranged between the sniffer 4 and the actual cleaning installation 6.

Figure 2:
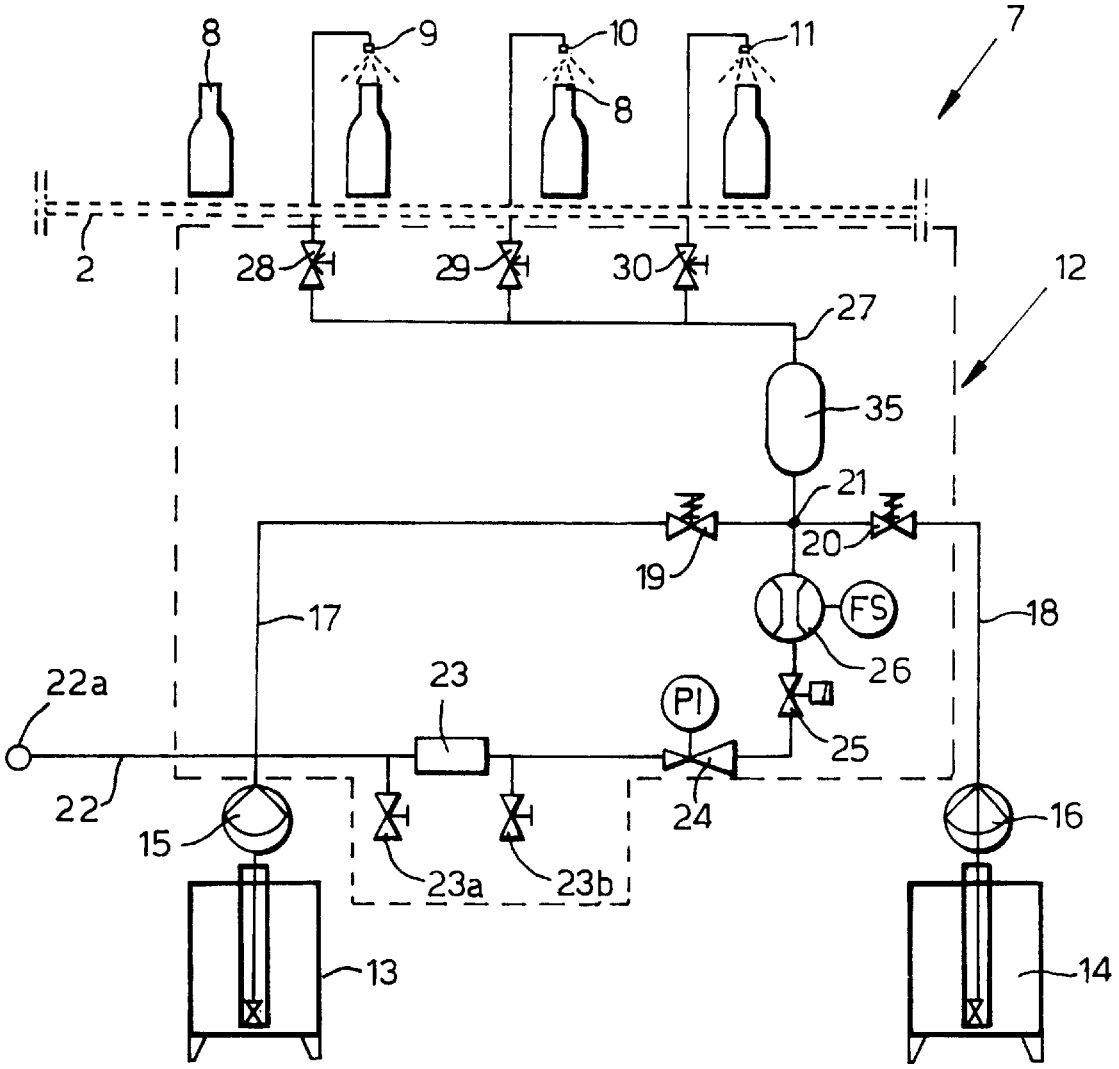
FIG. 2 shows a preferred embodiment of the pretreatment installation.

FIG. 2 shows a preferred embodiment of the pretreatment installation 7. The installation comprises a number of spray nozzles 9, 10, 11 which are arranged in a row over the belt conveyor 2, directly above the bottle openings 9, a mixing device 12 and a container 13 which contains the cleaning formulation as well as a container 14 which contains lye, acid or the stabilizer solution are directed by means of diaphragm pumps 15, 16, via delivery lines 17, 18 in which metering valves 19, 20 are arranged, to a mixing point 21, a water line 22 which is connected at a water connection 22*a* also leading to this mixing point. Also arranged in the water line 22, for rinsing purposes, is a pipe discconnector 23 with an emptying tap 23*a* arranged upstream of its inlet and an emptying tap 23*b* arranged downstream of its inlet. The pipe disconnector 23 is followed by a pressure reducer 24, a solenoid valve 25 for automatically disconnecting the water supply, for example, when the belt conveyor 2 comes to a standstill, and a flow meter 26. The mixing point 21 is connected to the spray nozzles 9, 10, 11 via a branching delivery line 27, in which an air chamber 35 is arranged, needle valves 28, 29, 30 for setting the volume of liquid discharged from the nozzles in dependence on the strength or nature of the dirt being arranged in the individual line branches. In order to minimize atomization in the ambient air, the spray nozzles are encapsulated.

Figure 3:
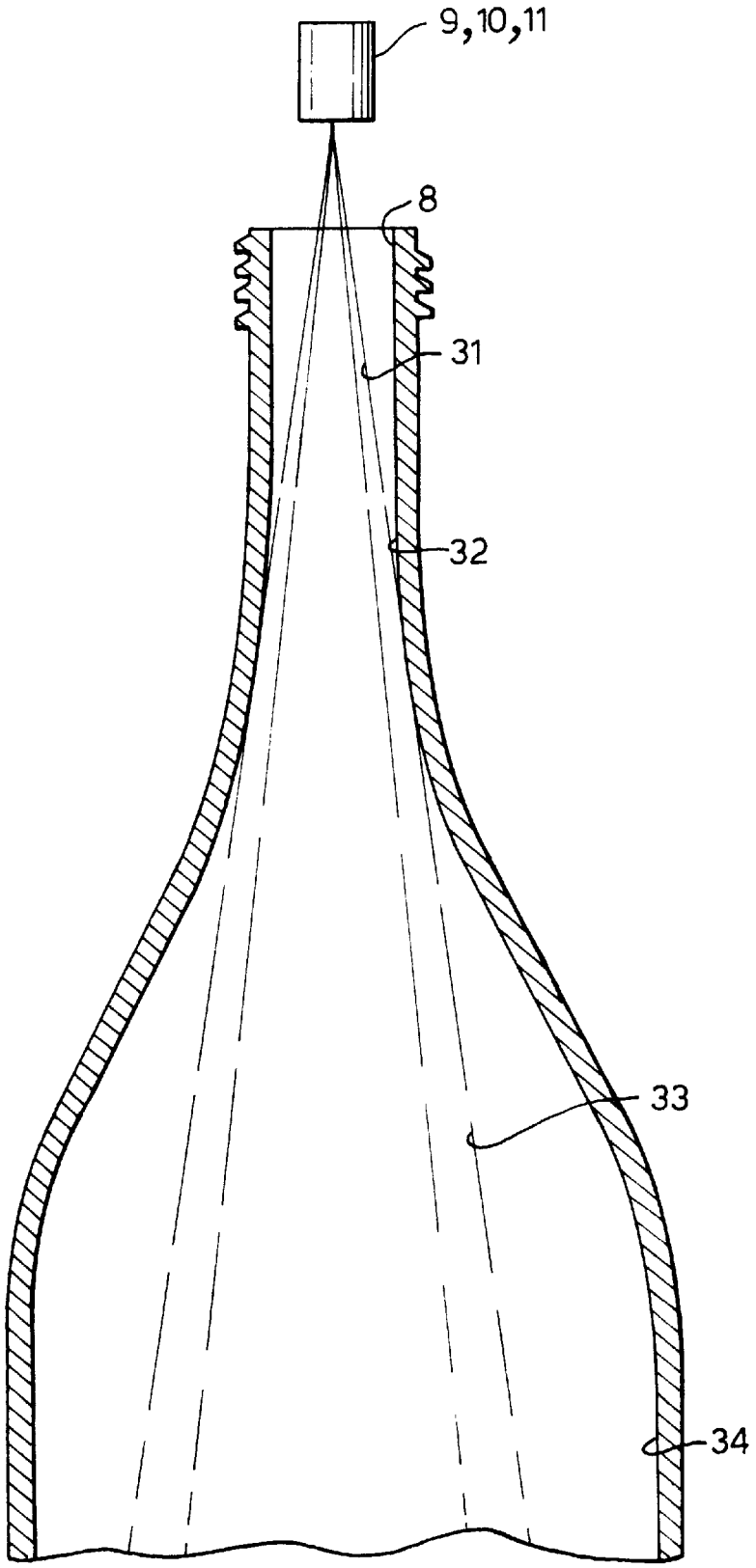
FIG. 3 shows the spray pattern made by the spray nozzles.

FIG. 3 shows the spray pattern made by the spray nozzles 9, 10, 11 arranged above the bottle openings 8. The spray nozzles are designed such that they produce a spray jet in the form of a hollow cone. The rotationally symmetrical spray jet 31 essentially follows the contour of the bottle neck 32, which widens in the downward direction. Beneath the bottle neck 32, the spray jet 31 is transformed into a fine spray mist which descends uniformly on to the cylindrical inner wall 343 of the bottles. The spray mist is illustrated by dashed lines, and provided with the reference numeral 33, in FIG. 3. While the bottles are moving on the belt conveyor 2 in the direction of the cleaning installation 6, the cleaning formulation detaches the adhering dirt, which is then removed in the cleaning installation 6 together with the cleaning formulation.

I claim:

1. A process for mechanically cleaning a reusable container made of glass or plastic in a cleaning installation having one or more washing cycle or zones and rinsing cycles or zones, the process comprising the steps of:

a) spraying an aqueous cleaning formulation onto reusable containers in a cleaning installation by means of one or more spray nozzles which produce a spray jet which is directed into an interior of each of the reusable containers through an opening in each of the containers;

b) forming a spray mist from the spray jet in each of the interiors of the containers which uniformly distributes the aqueous cleaning formulation in each interior, the aqueous cleaning formulation comprising
(i) 30 to 50% of an inorganic acid,
(ii) 18 to 28% of a wetting agent,
(iii) 2 to 7% of a dispersing polymer,
(iv) 2 to 7% of a threshold agent, 5 to 10% of a chelating agent, and
(v) water; and c) removing dirt, microorganisms and the aqueous cleaning formulation from the containers in the cleaning installation.

2. The process according to claim 1 wherein the aqueous cleaning formulation further comprises at least 0.5% wt. of at least one active detergent.

3. The process according to claim 1 wherein the cleaning formulation has a contact time in the containers of between 0.5 and 30 minutes.

4. The process according to claim 1 wherein during the spraying step (a) in the cleaning installation, a conveying device conveys the reusable containers in one or more rows.

5. The process according to claim 1 wherein in the spraying step (a) a volume of liquid discharge from each of the spray nozzles is between 1 and 20 liters per hour.

6. The process according to claim 1 wherein in the spraying step (a) the containers are plastic bottles sprayed with a jet in the form of a hollow cone.

7. The process according to claim 1 wherein prior to the spraying of the aqueous cleaning formulation onto the containers, the containers are checked to determine if they have been previously filled with substances which are a health hazard and, if such substances are detected, the containers are directed away for final recovery.

* * * * *